US006672284B2

(12) United States Patent
Majima

(10) Patent No.: US 6,672,284 B2
(45) Date of Patent: Jan. 6, 2004

(54) FUEL SUPPLY AMOUNT CONTROL APPARATUS FOR INTERNAL COMBUSTION ENGINE

(75) Inventor: Yoshihiro Majima, Inuyama (JP)

(73) Assignee: Denso Corporation, Aichi-pref. (JP)

( * ) Notice: Subject to any disclaimer, the term of this patent is extended or adjusted under 35 U.S.C. 154(b) by 165 days.

(21) Appl. No.: 09/977,212

(22) Filed: Oct. 16, 2001

(65) Prior Publication Data

US 2002/0043247 A1 Apr. 18, 2002

(30) Foreign Application Priority Data

Oct. 18, 2000 (JP) ..... 2000-317812

(51) Int. Cl.[7] ..... F02D 41/14

(52) U.S. Cl. ..... 123/436; 123/681; 123/682; 123/491; 701/103; 701/104; 701/110

(58) Field of Search ..... 123/436, 491, 123/675, 681, 492, 682, 493; 701/103, 104, 105, 110, 113

(56) References Cited

U.S. PATENT DOCUMENTS 5,038,737 A * 8/1991 Nishiyama et al. .... 123/406.42
5,448,978 A * 9/1995 Hasegawa et al. ..... 123/480
5,623,913 A * 4/1997 Kitajima et al. ..... 123/673
5,636,621 A * 6/1997 Maki et al. ..... 123/673
6,085,518 A * 7/2000 Yamashita et al. ..... 60/276
6,550,465 B2 * 4/2003 Ueno et al. ..... 123/679

FOREIGN PATENT DOCUMENTS

| | | | | |
|---|---|---|---|---|
| JP | 54345 | * | 3/1991 | ..... F02D/45/00 |
| JP | 124940 | * | 5/1991 | ..... F02D/41/14 |
| JP | 8-170557 | | 7/1996 | |
| JP | 8-177574 | | 7/1996 | |
| JP | 159628 | * | 6/1998 | ..... F02D/41/14 |

* cited by examiner

*Primary Examiner*—Henry C. Yuen
*Assistant Examiner*—Hai Huynh
(74) *Attorney, Agent, or Firm*—Nixon & Vanderhye PC

(57) ABSTRACT

When control conditions are satisfied, an A/F value is estimated from an average value of rotation speed Ne and an increasing rotation speed ΔNe calculated. The estimated A/F value as a base is obtained from the average value of the rotation speed Ne, and a correction value for the estimated A/F value is obtained from the increasing rotation speed ΔNe. Then, a fuel increment/decrement correction coefficient γ and an air increment/decrement correction coefficient β are calculated, and used in the control of A/F ratio toward a target A/F value based on a final estimated A/F value.

13 Claims, 9 Drawing Sheets

PREDETERMINED VALUE 1

| STARTUP WATER TEMP. | -10 | 0 | 10 | 20 | 30 | 40 |
|---|---|---|---|---|---|---|
| PREDETERMINED VALUE 1 | 250 | 220 | 200 | 180 | 150 | 130 |

PREDETERMINED VALUE 2

| STARTUP WATER TEMP. | -10 | 0 | 10 | 20 | 30 | 40 |
|---|---|---|---|---|---|---|
| PREDETERMINED VALUE 2 | 800 | 900 | 900 | 900 | 900 | 900 |

| LAST TIME INCREASING ΔNe | 50 | 100 | 150 | 200 |
|---|---|---|---|---|
| CORRECTION COEFFICIENT | 0.9 | 1.0 | 1.1 | 1.2 |

| Ne AVERAGE | 1500 | 1200 | 900 | 600 |
|---|---|---|---|---|
| ESTIMATED A/F-BASE | 13 | 15 | 17 | 20 |

FIG. 10

| ΔNE ADDITION | 50 | 100 | 150 | 200 |
|---|---|---|---|---|
| ESTIMATED A/F1 CORRECTION VALUE | 0 | -1 | -1.5 | -2 |

FIG. 11

| ΔNE DEVIATION | 5 | 10 | 15 | 20 |
|---|---|---|---|---|
| ESTIMATED A/F2 CORRECTION VALUE | 0 | 0 | +0.5 | +1 |

FIG. 12

| DECREASING ΔNE | 50 | 100 | 150 | 200 |
|---|---|---|---|---|
| ESTIMATED A/F CORRECTION VALUE | 0 | -0.5 | -1.0 | -1.5 |

$\gamma$

| ESTIMATED A/F | 13 | 14 | 15 | 16 | 17 | 18 |
|---|---|---|---|---|---|---|
| $\gamma$ | 0.9 | 0.95 | 1.0 | 1.05 | 1.1 | 1.15 |

$\beta$

| ESTIMATED A/F | 13 | 14 | 15 | 16 | 17 | 18 |
|---|---|---|---|---|---|---|
| $\beta$ | 1.2 | 1.05 | 1.0 | 1.0 | 1.0 | 1.0 |

Ne(rpm)
IG-ON
1000
0
TARGET Ne
TIME

INCREASING
ΔNe COUNTER
0
AFTER CONDITION SATISFIED n=5
TIME

DECREASING ΔNe
ON
OFF
STARTUP
TIME

IGNITION TIMING
10
0
-10
TIME
TARGET
IGNITION TIMING

A/F
17
15
13
TARGET A/F
ESTIMATED A/F

AVERAGE(rpm)
1000
AVERAGE Ne
TARGET Ne
TIME

ΔNe
TIME

FUEL SUPPLY AMOUNT CONTROL APPARATUS FOR INTERNAL COMBUSTION ENGINE

CROSS REFERENCE TO RELATED APPLICATION

This application is based on and incorporates herein by reference Japanese Patent Application No. 2000-317812 filed on Oct. 18, 2000.

BACKGROUND OF THE INVENTION

1. Field of the Invention

The present invention relates to an apparatus to control an amount of fuel supply to an internal combustion engine.

2. Description of Related Art

Conventionally, a technique to determine the properties of fuel based on variations in rotation speed Ne upon or immediately after startup of internal combustion engine is known.

However, there is no technique to estimate an air-fuel ratio (hereinafter referred to "A/F") from the variation amount of the rotation speed Ne instead of the determination of fuel properties.

SUMMARY OF THE INVENTION

An object of the present invention is to provide an internal combustion engine fuel supply amount control apparatus to estimate an A/F based on the rotation speed Ne of the engine and accurately control the air-fuel ratio immediately after startup of the engine based on the estimated A/F.

According to the present invention in the internal combustion engine fuel supply amount control apparatus in claim 1, an air-fuel ratio of an internal combustion engine during a predetermined period is estimated based on a load on the internal combustion engine detected by load detection means. In this constitution, as the air-fuel ratio can be estimated in correspondence with the load on the internal combustion engine, control based on the air-fuel ratio can be performed even before an A/F sensor is activated. Especially, optimum combustion can be performed from the startup of the internal combustion engine. Note that the "load" here may be a general load such as an intake air amount, an intake pipe pressure and an intake air flow speed, but may more preferably be a rotation speed of the internal combustion engine.

BRIEF DESCRIPTION OF THE DRAWINGS

Additional objects and advantages of the present invention will be more readily apparent from the following detailed description of preferred embodiments thereof when taken together with the accompanying drawings in which:

FIG. 10 is a map for setting an estimated A/F 1 correction value;

FIG. 11 is a map for setting an estimated A/F 2 correction value;

FIG. 12 is a map for setting an estimated A/F 3 correction value;

DETAILED DESCRIPTION OF PREFERRED EMBODIMENT

Figure 1:
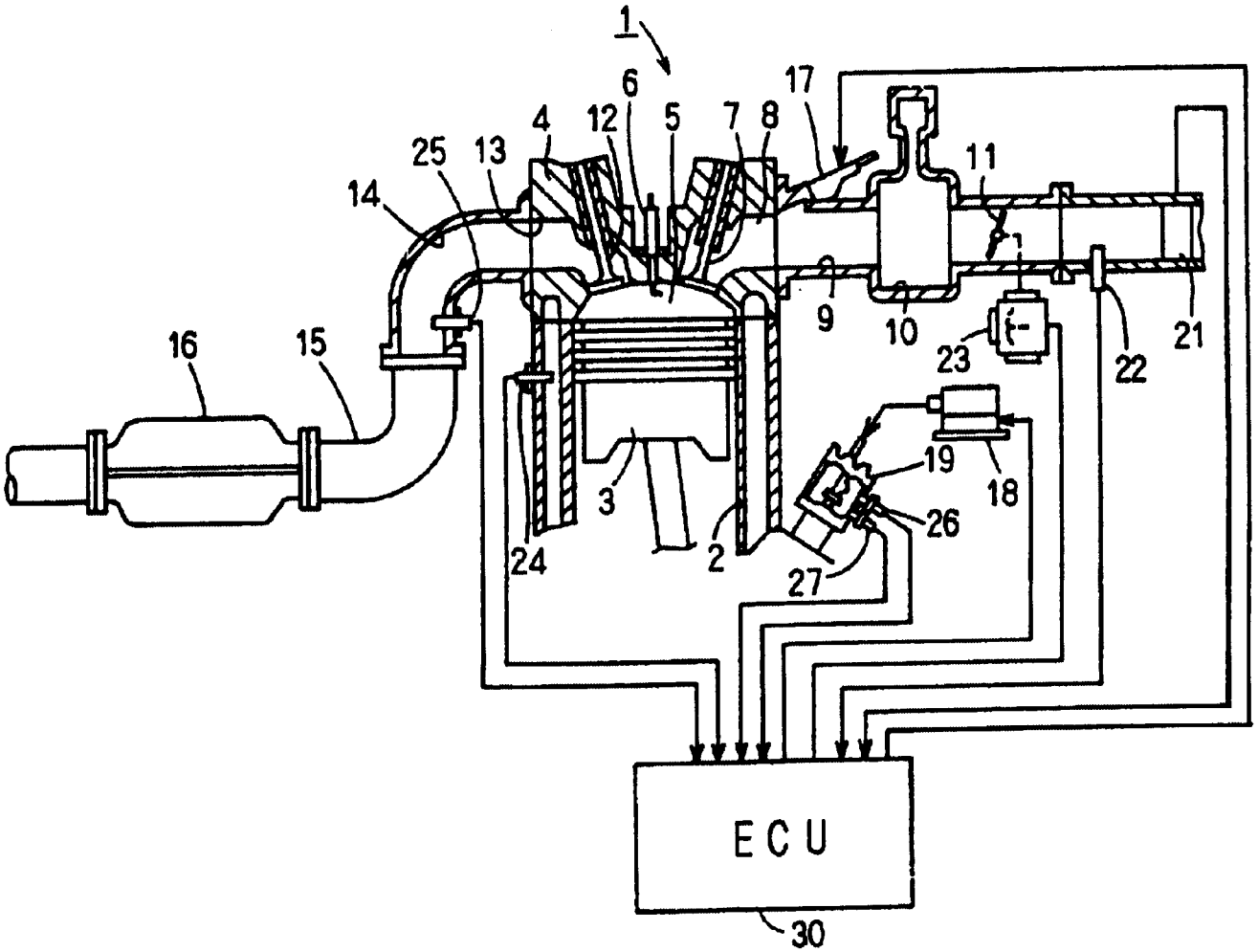
FIG. 1 is a schematic view showing an engine system including an internal combustion engine fuel supply amount control apparatus.

FIG. 1 shows the system configuration of an engine including a fuel supply amount control apparatus according to the embodiment.

As shown in FIG. 1, an engine 1 has a combustion chamber 5 formed with a cylinder 2, a piston 3 and a cylinder head 4. The combustion chamber 5 is provided with an ignition plug 6. An intake system of the engine 1 is provided with an intake port 8 communicated with the combustion chamber 5 via an intake valve 7, an intake manifold 9 connected to the intake port 8, a surge tank 10 which absorbs the pulse of intake air, and a throttle valve 11 which controls the amount of intake air. The throttle valve 11 is driven by a DC motor (not illustrated), and controlled to a throttle opening appropriate to a driving state. On the other hand, an exhaust system of the engine 1 is provided with an exhaust port 13 communicating with the combustion chamber 5 through an exhaust valve 12, an exhaust manifold 14 communicated with the exhaust port 13, an exhaust pipe 15 which leads an exhaust gas from the exhaust manifold 14, and a three-way catalyst 16 which cleans hazardous elements in the exhaust gas.

A fuel system of the engine 1 has a fuel supply source including a fuel tank and a fuel pump (not illustrated), a fuel supply pipe, and a fuel injection valve 17 provided around the intake port 8. Further, an ignition system of the engine 1 has an igniter 18 which outputs a high voltage necessary for ignition, and a distributor 19, interlocked with a crankshaft (not illustrated), which distributes the high voltage generated by the igniter 18 over the ignition plugs 6 of the respective cylinders.

The engine 1 has, as detectors, an air flow meter 21 provided upstream of the throttle valve 11, an intake air temperature sensor 22 provided in the intake pipe as intake air temperature detection means for measuring an intake air temperature, a throttle position sensor 23, interlocked with the throttle valve 11, which detects the opening of the throttle valve 11, a water temperature sensor 24 provided in a cooling system as cooling water temperature detection means for detecting an engine cooling water temperature, and an A/F sensor 25 provided in the exhaust manifold 14, which detects residual oxygen concentration in the exhaust gas as an analog signal.

Further, a rotation angle sensor 26, which also serves as a rotation speed sensor, and a cylinder determination sensor 27 are provided in the distributor 19. The rotation angle sensor 26 outputs a turning angle signal very 1/24rotation of camshaft of the distributor 19, i.e., every integral multiple of crank angle between 0° CA and 30° CA. The cylinder determination sensor 27 outputs a reference signal for every 1 rotation of the camshaft of the distributor 19, i.e., every 2 rotations of the crankshaft (not illustrated). The signals outputted by these respective sensors are inputted into an electronic control unit (hereinafter abbreviated to "ECU") 30. The ECU 30 controls the engine 1 by driving the fuel injection valve 17 and the igniter 18 based on the respective signals.

Figure 2:
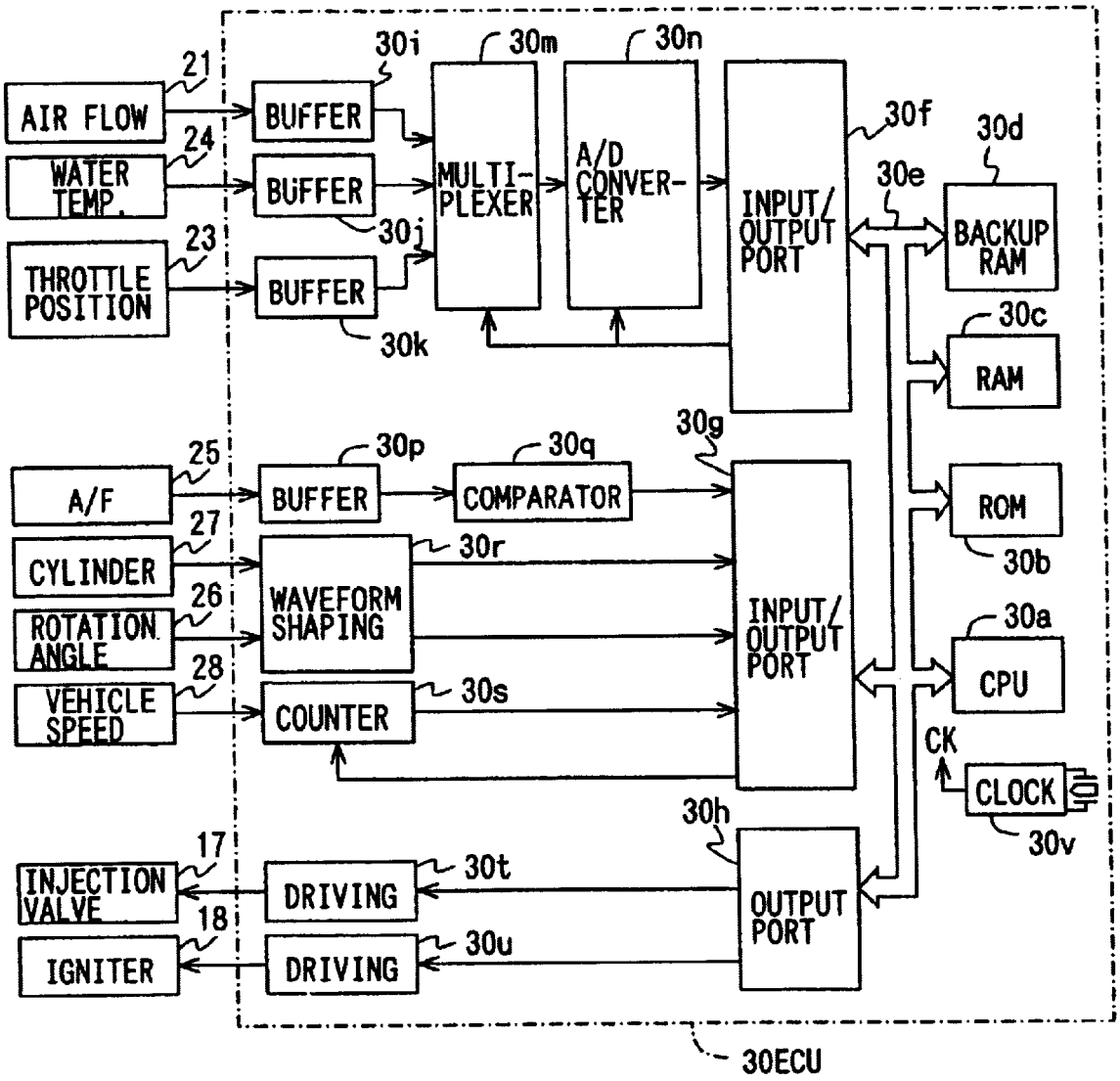
FIG. 2 is a block diagram showing an electronic control unit (ECU)

Next, the constitution of the ECU 30 will be described with reference to FIG. 2. The ECU 30 as a logical operation circuit mainly has a CPU 30*a* which inputs the signals outputted by the respective sensors, performs computation in accordance with a control program, and performs processing to control the respective devices, a ROM 30*b* in which the control program and initial data are stored in advance, a RAM 30*c* in which various signals inputted into the ECU 30 and data necessary for computation control are temporarily stored, a backup RAM 30*d* backed up by a battery such that even when a key switch of the engine 1 is turned OFF by a driver, the various data necessary for control of the engine 1 can be stored. These elements are connected to input/output ports 30*f*, 30*g* and an output port 30*h* via a common bus 30*e*, and the elements perform input/output with external devices.

The ECU 30 is provided with buffers 30*i*, 30*j* and 30*k* for storing output signals from the air flow meter 21, the water temperature sensor 24 and the throttle position sensor 23, and further provided with a multiplexer 30*m* which selectively outputs the output signals from the respective sensors to the CPU 30*a*, and an A/D converter 30*n* which converts an analog signal to a digital signal. The respective signals are inputted into the CPU 30*a* via the input/output port 30*f*. Further, the ECU 30 has a buffer 30*p* for storing an output signal from the A/F sensor 25, a comparator 30*q* which outputs a signal if an output voltage from the buffer 30*p* is equal to or higher than a predetermined voltage, a waveform shaping circuit 30*r* which shapes a waveform of an output signal from the turning angle sensor 26, and a counter circuit 30*s* for counting the number of output signals from a vehicle speed sensor 28.

These signals are inputted into the CPU 30*a* via the input/output port 30*g*. Further, the ECU 30 has driving circuits 30*t*, 30*u* which supply a driving current to the fuel injection valve 17 and the igniter 18. The CPU 30*a* outputs a control signal to the driving circuits 30*t*, 30*u* via the output port 30*h*. Further, the output port 30*h* is provided with compare A register and compare B register which output an interruption signal to the CPU 30*a* when time previously set by the CPU 30*a* has come. Note that the ECU 30 has a clock circuit 30*v* which sends a clock signal as control timing to the CPU 30*a*, the ROM 30*b*, the RAM 30*c* and the like, at predetermined intervals.

The control performed from the startup to the activation of the A/F sensor 25 in the present embodiment will be described with reference to FIGS. 3–13. First, the flowchart in FIG. 3 will be described. At step 100, it is determined whether or not an ignition switch (hereinbelow, abbreviated to "IG")(not shown) is ON. If the IG is not ON, the routine ends. If the IG is ON, the process proceeds to step 110. At step 110, it is determined whether or not the cooling water temperature in the engine 1 is lower than a predetermined temperature (e.g., 40° C.) and the A/F sensor 25 is inactive. If the two conditions are not satisfied, the process proceeds to step 220. If the two conditions are satisfied, the process proceeds to step 120.

Figures 4, 5, 6:
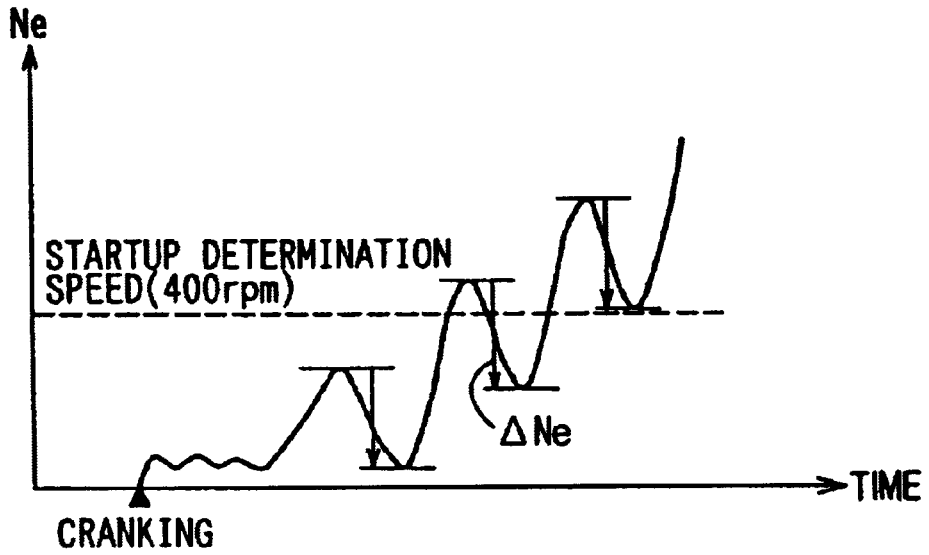
FIG. 4 is a graph showing a rotation speed Ne with respect to time.
FIG. 5 is a map for variably setting a predetermined value 1.
FIG. 6 is a map for variably setting a predetermined value 2.

At step 120, a decreasing rotation speed ΔNe is calculated. As shown in FIG. 4, when a rotation speed Ne has exceeded a determination value (e.g., 400 rpm) for determination of startup of the engine 1, the amount of decrement of rotation speed Ne between a peak rotation speed of the initial explosion and that of the next explosion is used as the decreasing rotation speed ΔNe. Further, it may be arranged such that the decreasing rotation speed ΔNe is obtained before and after the determination of the startup and one of them is used as a final decreasing rotation speed ΔNe, otherwise, an average value of these speeds is used as a final decreasing rotation speed ΔNe.

In this manner, the decreasing rotation speed ΔNe is calculated, and at step 130, the decreasing rotation speed ΔNe is compared with a predetermined value 1. The predetermined value 1 may be a fixed value of e.g. 200 rpm, otherwise, as shown in FIG. 5, the predetermined value 1 may be variably set from a map corresponding to the engine cooling water temperature or intake temperature detected by the intake air temperature sensor upon startup.

In the latter case, the predetermined value 1 is variably set in correspondence with the engine cooling water temperature or the intake air temperature since the fuel injected by the fuel injection valve 17 depends on the engine cooling water temperature. When the engine cooling water temperature is low, the viscosity of lubricating oil circulating in the engine 1 is high, and the loss due to friction upon reciprocating motion of the piston 3 increases. When the influence by the friction is large, the rotation speed Ne after explosion is low since the rotation force of the piston 3 by an inertial force is lost. For this reason, as the rotation speed Ne after explosion is low with respect to the peak rotation speed Ne upon explosion, the decreasing rotation speed ΔNe increases.

In consideration of this situation, in the map in FIG. 5, upon engine startup, the predetermined value 1 is less as the engine cooling water temperature is higher, and the predetermined value 1 is greater as the engine cooling water temperature is lower. If the decreasing rotation speed ΔNe is lower than the predetermined value 1, the process proceeds to step 150, while if the decreasing rotation speed ΔNe is higher than the predetermined value 1, the intake air amount is incrementally-corrected (step 140), and the process proceeds to step 150. The incremental correction on the intake air amount is made so as to prevent drop of the rotation speed Ne by raising the output due to high friction as described above. Further, it may be arranged such that if the friction is high, ignition timing retard is prohibited and the fuel injection amount is increased, and the routine is terminated.

At step 150, it is determined whether or not the peak rotation speed Ne after the engine startup is higher than a predetermined value 2. The predetermined value 2 may be set to e.g. 900 rpm, or may be variably set in correspondence with the engine cooling water temperature or the intake air temperature upon startup as shown in FIG. 6. In the latter case, the predetermined value 2 is variably set in correspondence with the engine cooling water temperature or the intake air temperature since the fuel properties can be determined by the peak of the rotation speed Ne upon initial explosion. That is, as the volatile characteristic of the fuel properties causes influence at a low temperature, the determination as to heaviness of the fuel can be made by the peak rotation speed Ne upon initial explosion.

In this manner, at step 150, if it is determined that the peak rotation speed Ne is lower than the predetermined value 2, i.e., the fuel is heavy fuel, the process proceeds to step 220. On the other hand, if it is determined that the peak rotation speed Ne is higher than the predetermined value 2, the process proceeds to step 160. At step 160, the ignition timing retard is performed to warm up the catalyst 16 at an early stage, and the process proceeds to step 170. The ignition timing retard is performed such that ignition timing is gradually retarded by each processing. At step 170, it is determined whether or not the current ignition timing has become a target ignition timing. If the current ignition timing has not become the target ignition timing, the routine ends. On the other hand, if it is determined that the current ignition timing has become the target ignition timing, the process proceeds to step 180.

At step 180, it is determined whether or not the rotation speed Ne is higher than a lower limit rotation speed Ne. The lower limit rotation speed Ne means a target rotation speed Ne in the idle driving state. If the rotation speed Ne is lower than the lower limit rotation speed Ne, the process proceeds to step 220. At step 220, normal control is performed. The normal control means conventionally well-known control performed if negative determination is made at steps 130, 150 and 180, i.e., the conditions at these steps are not satisfied, to prohibit the ignition timing retard and increment in the fuel injection amount.

On the other hand, if it is determined at step 180 that the rotation speed Ne is higher than the lower limit rotation speed Ne, processing at steps 190 to 210 as a characteristic feature of the present invention is performed. The characteristic feature of the present invention is to estimate an A/F from the value of rotation speed Ne, and perform air-fuel ratio control based on the estimated A/F.

Figures 7, 8, 9:
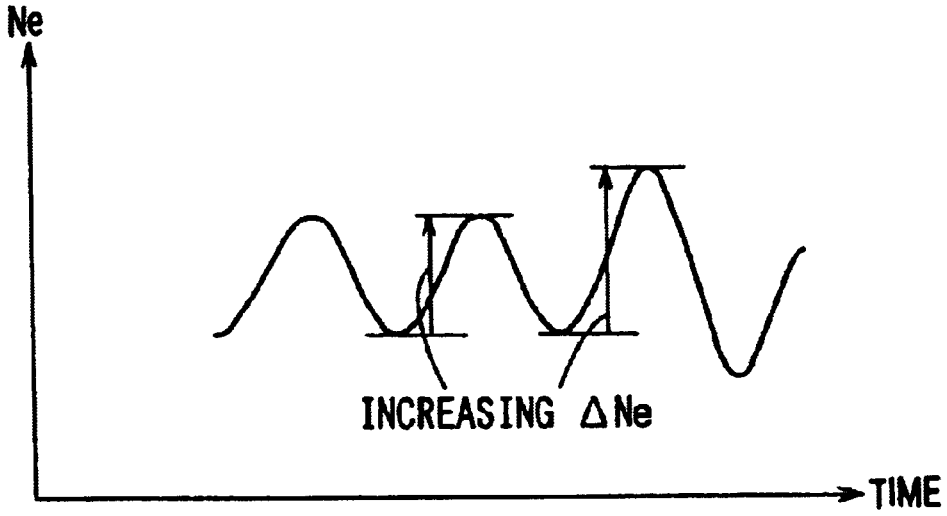
FIG. 7 is a graph showing the rotation speed Ne with respect to time.
FIG. 8 is a map for setting a correction coefficient.
FIG. 9 is a map for setting an A/F_Base value.

Hereinafter, the processing performed at steps 190 through 210 will be described. At step 190, an increasing rotation speed ΔNe is calculated as the rotation variation amount in increasing time as shown in FIG. 7. The increasing rotation speed ΔNe is calculated by subtracting the lowest rotation speed Ne after a previous explosion stroke from a peak rotation speed Ne upon explosion stroke. The calculation timing may be set with a rotation speed deviation between timing of ignition by the ignition plug 6 and timing of exhaust valve opening. Further, at this time, the current increasing rotation speed ΔNe may be corrected based on the previous increasing rotation speed ΔNe. The correction may be performed by multiplying the rotation speed by a correction coefficient set based on the map as shown in FIG. 8. In the map of FIG. 8, the correction coefficient is greater as the previous increasing rotation speed ΔNe is higher, while the correction coefficient less as the previous increasing rotation speed ΔNe is lower.

In this manner, the increasing rotation speed ΔNe is calculated five times, then the process proceeds to step 200. At step 200, the A/F is estimated from the increasing rotation speed ΔNe obtained at step 190 and an average value of the rotation speeds Ne. The estimation of the A/F is made by setting an estimated A/F_Base value from the map in FIG. 9 based on the average value of the rotation speed Ne. A final estimated A/F value is set by adding various correction A/F values to the set A/F_Base value. As the various correction values, an estimated A/F 1 correction value, an estimated A/F 2 correction value and an estimated A/F 3 correction value are set based on the maps in FIGS. 10–12.

If driving is performed when the air-fuel ratio of the internal combustion engine is rich, as variation does not occur in torque fluctuation, the increasing rotation speed ΔNe almost does not change. On the other hand, if driving is performed when the air-fuel ratio of the internal combustion engine is lean, as torque fluctuation is easily caused, variation occurs in the increasing rotation speed ΔNe. Further, the influence of friction resistance upon piston reciprocating motion also influences the increasing rotation speed ΔNe.

Thus, the estimated A/F 1 correction value is set in consideration of the influence by the friction of the internal combustion engine, based on the map as shown in FIG. 10, with respect to a value obtained by integrating five times the increasing rotation speed ΔNe by each 30° CA. In the map in FIG. 10, if the integrated value of the increasing rotation speed ΔNe is large, the influence of the friction is small, accordingly, the estimated A/F 1 correction value is corrected to a rich value.

The estimated A/F 2 correction value is set based on the map as shown in FIG. 11 in correspondence with a deviation between a maximum value and a minimum value of the five increasing rotation speeds ΔNe calculated at step 190. As it can be determined whether or not rotation variation has occurred by the torque fluctuation based on the deviation between the maximum and minimum values of the increasing rotation speeds ΔNe, if the deviation is large, it is determined that driving is performed while the estimated air-fuel ratio is lean. Accordingly, if the deviation is large, the air-fuel ratio is corrected to a lean ratio, while if the deviation is small, the estimated air-fuel ratio is corrected to a rich ratio.

The estimated A/F 3 correction value is set in consideration of the influence of the friction, based on the map in FIG. 12, in correspondence with the decreasing rotation speed ΔNe obtained as shown in FIG. 4. In the map in FIG. 12, if the decreasing rotation speed ΔNe is high, as the friction by the friction resistance or the like is small, the correction coefficient is set to correct the estimated air-fuel ratio to a lean ratio. If the decreasing rotation speed ΔNe is low, the correction coefficient is set to correct the estimated air-fuel ratio to a rich ratio.

Further, the various correction values may be set by computation. When the A/F_Base value and the three correction values are set as described above, an estimated A/F value is calculated in accordance with the following expression.

$$\text{Estimated } A/F \text{ value} = A/F_\text{Base value} + \text{estimated } A/F\ \mathbf{1} \text{ correction value} + A/F\ \mathbf{2} \text{ correction value} + A/F\ \mathbf{3} \text{ correction value} \quad (1)$$

In this manner, the estimated A/F value is calculated, and the process proceeds to step 210. Note that if the estimated A/F value is equal to or less than 15, i.e., it is a rich ratio, and the rotation speed Ne is equal to or lower than a predetermined rotation speed, the estimated A/F value is set to 15.

Figures 13, 14, 16:
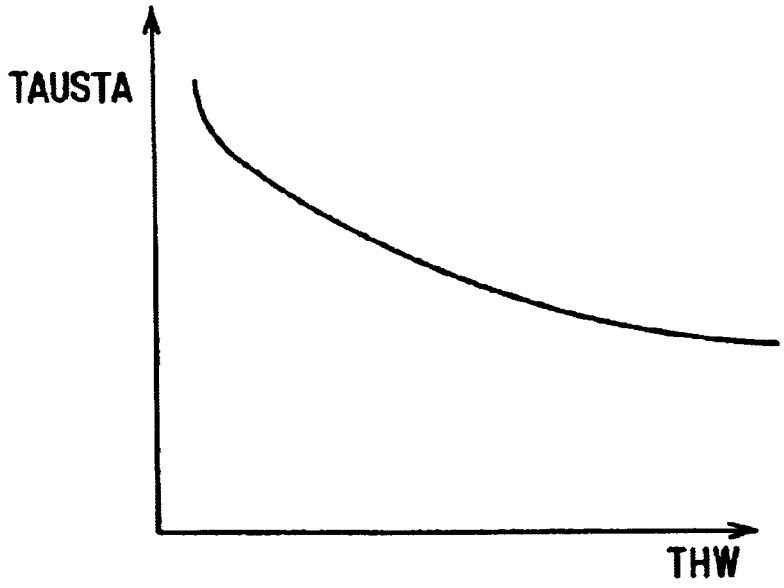
FIG. 13 is a map for setting the fuel increment/decrement correction coefficient γ.
FIG. 14 is a map for setting the air increment/decrement correction coefficient β.
FIG. 16 is a graph showing a method of calculating a startup fuel injection amount TAUSTA with respect to an engine cooling water temperature THW.

At step 210, to correct the fuel injection amount and the intake air amount based on the estimated A/F value calculated at step 200, a fuel increment/decrement correction coefficient γ and an air increment/decrement correction coefficient β are calculated. As shown in FIG. 13, the fuel increment/decrement correction coefficient γ is set in correspondence with the estimated A/F value calculated at step 200 in FIG. 3. In this map, as the estimated A/F value is greater (lean), the correction coefficient is greater. Similarly, as shown in FIG. 14, the air increment/decrement correction coefficient β is set in correspondence with the estimated A/F value calculated at step 200 in FIG. 3. In this map, as the estimated A/F value is greater, the correction coefficient is less.

Figure 15:
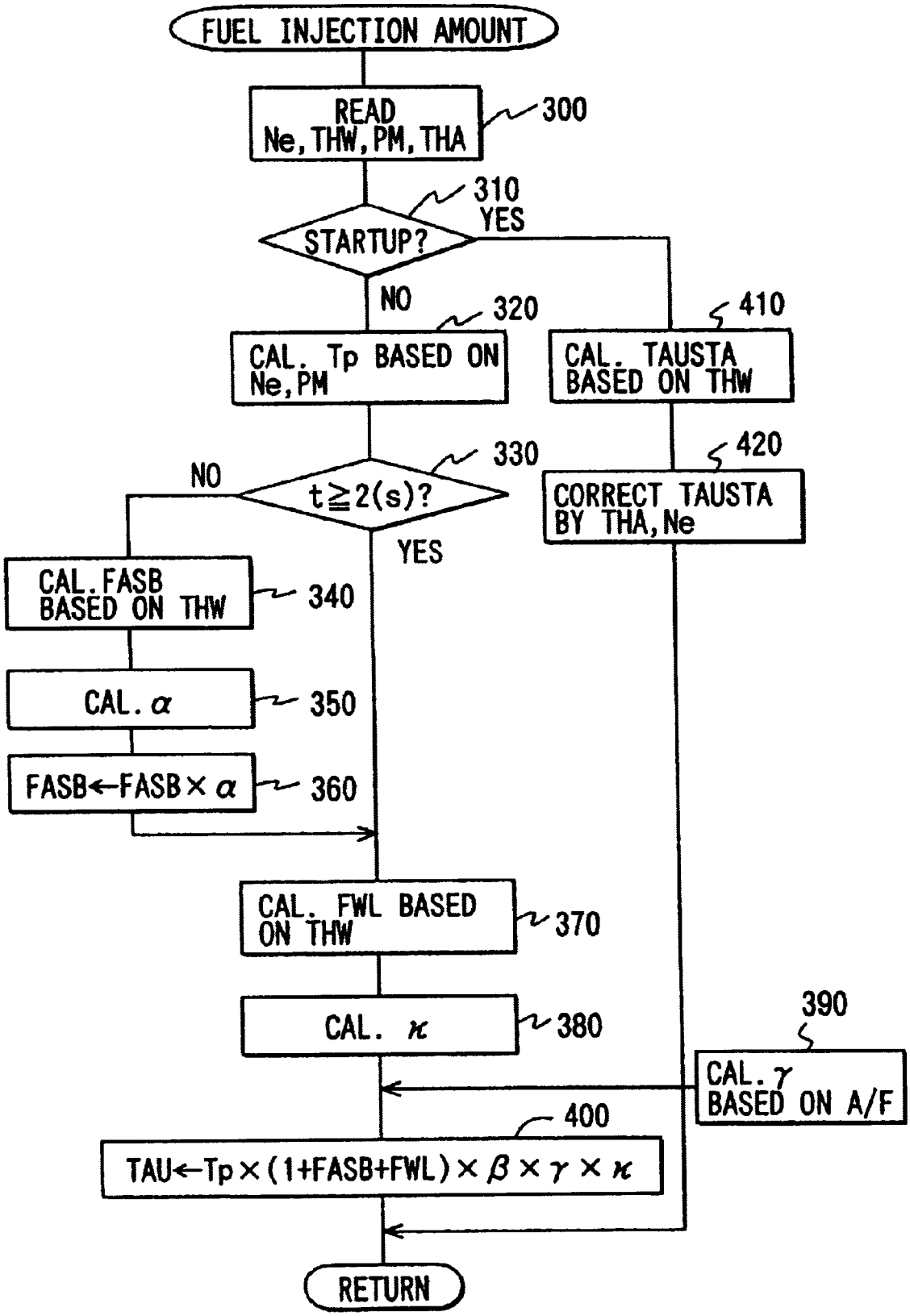
FIG. 15 is a control flowchart showing processing to calculate a fuel injection amount.

In the routine, the fuel increment/decrement correction coefficient γ and the air increment/decrement correction coefficient β are calculated in this manner. In the following fuel injection amount calculation routine in FIG. 15, the fuel injection amount is calculated in consideration of in the two correction coefficients γ and β. The details will be described with reference to FIG. 15. First, at step 300, the engine rotation speed Ne, the engine cooling water temperature THW, an intake pipe pressure PM, and an intake air temperature THA are read, and the process proceeds to step 310. The intake pipe pressure PM, the engine rotation speed Ne, the engine cooling water temperature THW and the intake air temperature THA are read at step 300 since these values are used as parameters necessary for calculation of fuel injection amount upon startup and its correction value, and basic fuel injection amount after startup and its correction value at the subsequent steps.

At step 310, it is determined whether or not startup time has come. If it is determined at step 310 that the startup time has come, the process proceeds to step 410. At step 410, a startup fuel amount TAUSTA is calculated from the characteristic diagram of FIG. 16 showing the relation between the engine cooling water temperature THW and the startup fuel amount TAUSTA, and the process proceeds to step 420. According to the characteristic diagram in FIG. 16, as the engine cooling water temperature raises, the startup fuel amount TAUSTA decreases. When the startup fuel amount is calculated, the startup fuel amount TAUSTA is corrected by the intake air temperature THA, the engine rotation speed Ne and the like at step 420, and the routine ends. Upon startup, as a high output is required and the volatility of the fuel is degraded due to a low engine cooling water temperature, the air-fuel ratio is controlled to the rich side, to ensure startability. The startup fuel amount corrected at step 420 is set to a larger injection amount in comparison with the fuel injection amount after the startup. If it is determined at step 310 that the startup time has not come, the process proceeds to step 320. At step 320, a basic injection amount Tp as a base of the fuel injection amount is calculated from the engine rotation speed Ne, read in response to the sensor output of the turning angle sensor 26, and the intake pipe pressure PM, read in response to the sensor output from the intake pipe pressure sensor 21, and the process proceeds to step 330. At step 330, it is determined whether or not two or more seconds have elapsed since the startup of the engine 1. If it is determined that 2 or more seconds have elapsed, the process proceeds to step 370, while if it is determined that two or more seconds have not elapsed, proceeds to step 340.

At step 340, an post-startup increment coefficient FASE is calculated from the engine cooling water temperature THW. To prevent radical change in the air-fuel ratio and move the air-fuel ratio mildly to the lean side, the fuel injection amount must be mildly attenuated from the startup amount to the post-startup amount. For this purpose, the post-startup increment coefficient FASE is calculated from the engine cooling water temperature THW. When the post-startup increment coefficient FASE has been calculated, the process proceeds to step 350. At step 350, a correction coefficient a is set as an ignition timing correction value .CLD. Note that as the ignition timing correction value .CLD, the correction coefficient α is set such that the ignition timing is gradually retarded for prevention of radical torque fluctuation until a target ignition timing retard value is finally obtained, and thereafter, the correction coefficient α is set as a fixed value. When the correction coefficient a has been set in this manner, the process proceeds to step 360. At step 360, the post-startup increment coefficient FASE is multiplied by the correction coefficient a, to set a new post-startup increment coefficient, and the process proceeds to step 370. In this manner, during two seconds after the startup, the processing at steps 340 through 360 is repeated, and if it is determined that two or more seconds have elapsed, the processing at steps 370 through 400 is performed.

Figure 3:
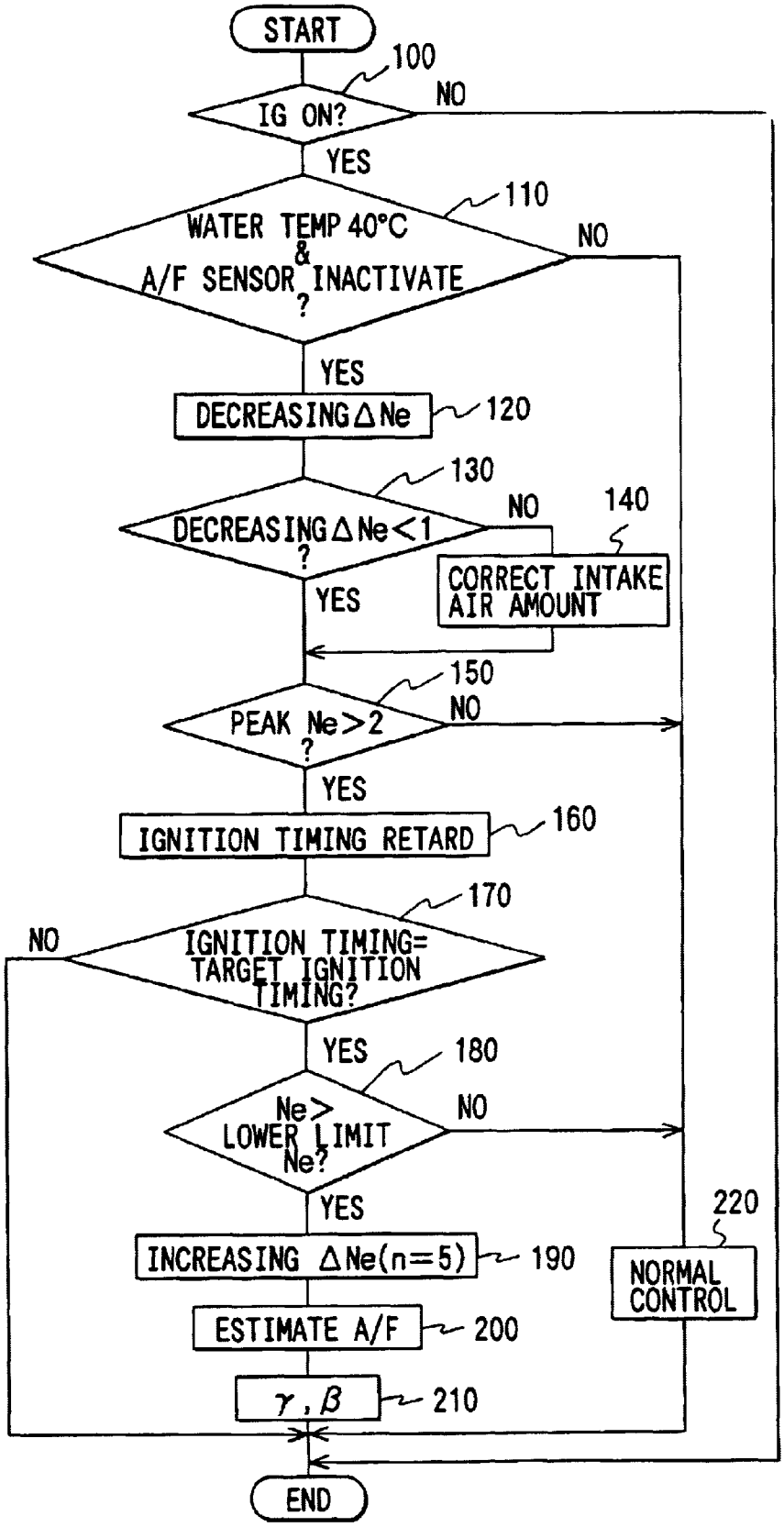
FIG. 3 is a flowchart showing processing to estimate an air-fuel ratio and calculate an air increment/decrement correction coefficient β and a fuel increment/decrement correction coefficient γ based on the estimated air-fuel ratio.

At step 370, a warm-up increment coefficient FWL is calculated from the engine cooling water temperature THW, and the process proceeds to step 380. At step 380, an another correction coefficient κ is calculated from the output from the A/F sensor 25 or the like, and the process proceeds to is step 390. At step 390, the fuel increment/decrement correction coefficient γ calculated at step 210 in the flowchart of FIG. 3 is read, and the process proceeds to step 400. At step 400, a final fuel injection amount TAU is calculated based on the respective correction coefficients set at steps 380 and 390. Specifically, the calculation is made by the following expression.

$$TAU=Tp\times(1+FASE+FWL)\times\beta\times\gamma\times\kappa \quad (2)$$

In this manner, the fuel injection amount TAU is calculated, and the routine ends. Further, in the present embodiment, after a lapse of two seconds from the startup, the post-startup increment coefficient FASE calculated at step 360 is attenuated after a lapse of predetermined period or a predetermined crank angle by a routine (not illustrated). The attenuation may be made by multiplication of the post-startup increment coefficient FASE by a constant λ greater than zero and less than one, or by subtraction of constant value A from the post-startup increment coefficient FASE. Further, in the present embodiment, the initial value of the post-startup increment coefficient FASE is changed in correspondence with the ignition timing correction value .CLD, however, the rate of attenuation may be changed, otherwise, the initial value of the post-startup increment coefficient FASE may be changed with control to change a holding time of the fuel injection amount immediately after the startup.

Figures 17A, 17B, 17C, 17D, 17E, 17F, 17G:
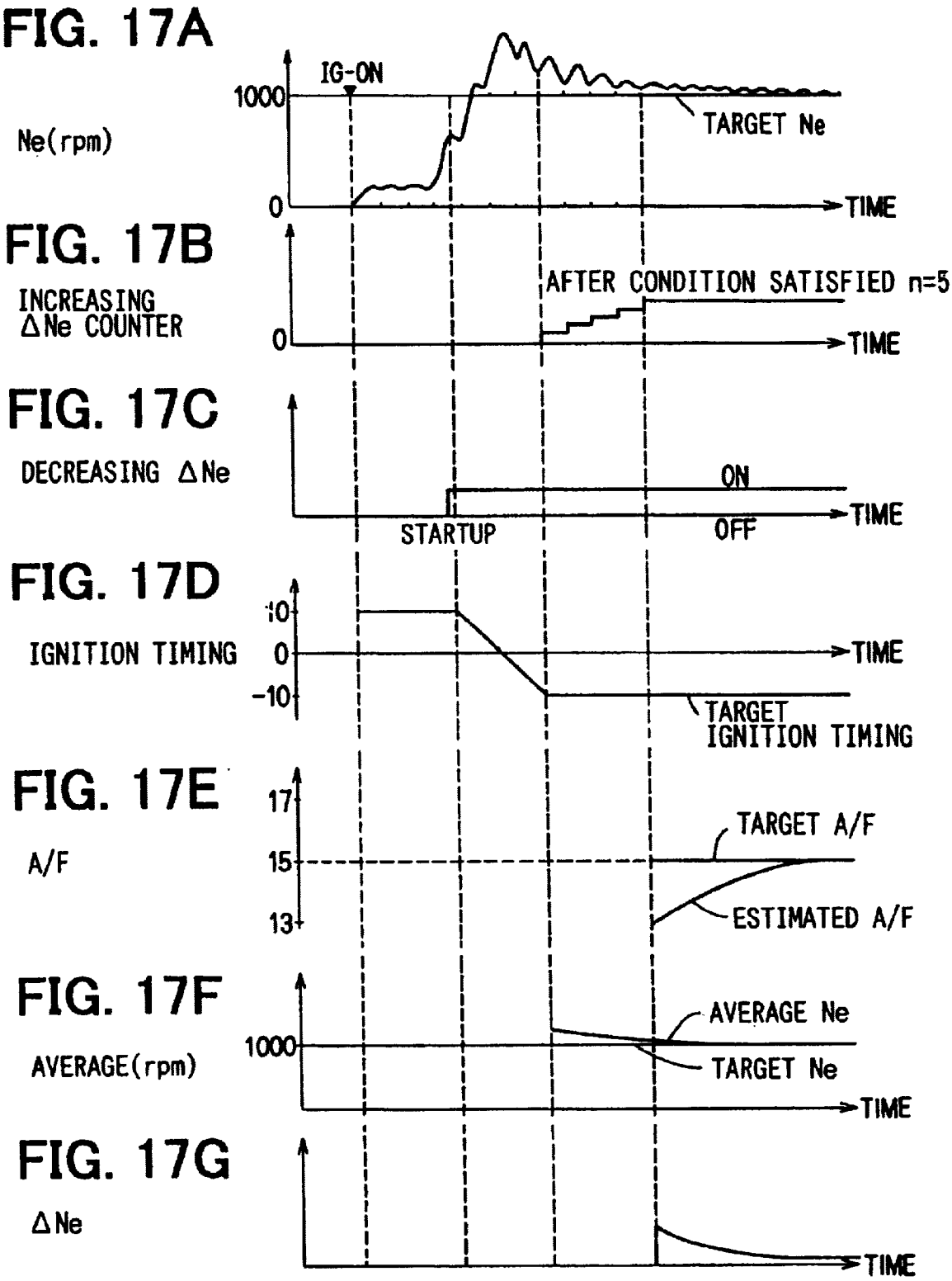
FIGS. 17A–17G are timing charts of control in the present embodiment.

In the present embodiment, even in a driving state where the A/F sensor 25 is not active, the air-fuel ratio can be estimated and the fuel injection amount TAU can be set to attain the target air-fuel ratio. The control of the present embodiment in this manner will be described with reference to the timing charts of FIGS. 17A–17G. FIG. 17A shows the engine rotation speed Ne. As shown in the figure, when the IG is turned ON, the crankshaft is turned by a starter (not illustrated), and when the rotation speed exceeds e.g. 400 rpm, it is determined that the engine 1 has started. As shown in FIG. 17C, a flag for calculation of the decreasing rotation speed ΔNe from a point immediately before the startup is turned on, and the decreasing rotation speed ΔNe is calculated. Further, when it is determined that the engine 1 has started, the ignition timing is gradually retarded toward the target ignition timing as shown in FIG. 17D. When the ignition timing is set to the target ignition timing, if conditions are satisfied from detection of initial explosion as shown in FIG. 17B, the increasing rotation speed ΔNe is calculated five times. FIG. 17F shows the average value of the engine rotation speed Ne. The estimated A/F_Base value is set based on the average value of the rotation speed Ne, and the three correction values for the estimated A/F_Base value are set from the increasing rotation speed ΔNe as shown in FIG. 17G and the decreasing rotation speed ΔNe as shown in FIG. 17D. Then finally, the estimated A/F value is calculated as an estimated value of the air-fuel ratio as shown in FIG. 17E. In the present embodiment, based on the estimated A/F value obtained as above, the fuel is increased to control the air-fuel ratio to the rich side or the fuel is decreased to control the air-fuel ratio to the lean side.

Note that in the present embodiment, as target air-fuel ratio setting means, the target air-fuel ratio is set to the lean side with ignition timing retard to warm up the catalyst at an early stage. The control based on the deviation between the target air-fuel ratio and the estimated air-fuel ratio may be conventionally known control such as feedback control or setting of fuel injection amount from a map. In any case, it is preferable that the control is performed with high precision.

Further, in the present embodiment, the air-fuel ratio is estimated by using the variation amount or average value of rotation speed, however, the air-fuel ratio may be estimated by general load on the internal combustion engine such as the intake air amount, the intake pipe pressure, or an intake flow speed.

Note that in the present embodiment, step 120 in FIG. 3 functions as load detection means; steps 190–200 in FIG. 3, air-fuel ratio estimation means; step 120 in FIG. 3, rotation speed detection means; step 120 in FIG. 3, variation amount calculation means; FIG. 9, average value calculation means; step 300 in FIG. 15, crank angle detection means; FIGS. 1–12 and FIG. 14, correction means; and steps 320–420 in FIG. 15, air-fuel ratio control means.

What is claimed is:

1. An internal combustion engine fuel supply amount control apparatus comprising:

load detection means for detecting a load on an internal combustion engine;

air-fuel ratio estimation means for estimating an air-fuel ratio of the internal combustion engine during a predetermined period based on the load on the internal combustion engine detected by the load detection means;

fuel injection amount control means for controlling a fuel injection amount based on the air-fuel ratio estimated by the air-fuel ratio estimation means:

wherein the load detection means includes rotation speed detection means for detecting a rotation speed of the internal combustion engine as the load on the internal combustion engine;

variation amount calculation means for calculating a rotation speed variation amount based on the rotation speed detected by the rotation speed detection means; and average value calculation means for calculating a rotation speed average value based on the rotation speed during the predetermined period detected by the rotation speed detection means, wherein the air-fuel ratio estimation means estimates the air-fuel ratio of the internal combustion engine based on the rotation speed variation amount calculated by the variation amount calculation means and the rotation speed average value calculated by the average value calculation means.

2. An internal combustion engine fuel supply amount control apparatus according to claim 1, further comprising crank angle detection means for detecting a crank angle of a crankshaft connected to the internal combustion engine, wherein the variation amount calculated by the variation amount calculation means is a deviation within a predetermined crank angle detected by the crank angle detection means.

3. An internal combustion engine fuel supply amount control apparatus according to claim 1, wherein the rotation speed variation amount calculated by the variation amount calculation means is a deviation between the rotation speed upon startup of combustion and that upon end of combustion in the internal combustion engine.

4. An internal combustion engine fuel supply amount control apparatus according to claim 1, further comprising:

an exhaust valve that controls exhaust timing to discharge burned gas in the internal combustion engine; and an ignition plug that causes air-fuel mixture to burn in the internal combustion engine, wherein the rotation speed variation amount calculated by the variation amount calculation means is a deviation between the rotation speed upon ignition by the ignition plug and that upon opening of the exhaust valve.

5. An internal combustion engine fuel supply amount control apparatus according to claim 1, wherein the variation amount calculation means calculates a predetermined number of variation amounts, and calculates a final variation amount by at least one of an average value of the predetermined number of variation amounts, variation in the predetermined number of variation amounts, the total of the predetermined number of variation amounts, and a deviation between a maximum value and a minimum value of the predetermined number of variation amounts.

6. An internal combustion engine fuel supply amount control apparatus according to claim 1, wherein the air-fuel ratio estimation means includes:

basic air-fuel ratio estimation means for setting a basic air-fuel ratio from an intake air amount of air which flows in the internal combustion engine and a fuel injection amount of fuel injected from a fuel injection valve; and correction means for correcting the basic air-fuel ratio based on the variation amount calculated by the variation amount calculation means.

7. An internal combustion engine fuel supply amount control apparatus according to claim 6, wherein the basic air-fuel ratio estimation means is set from a map based on the average rotation speed value detected by the rotation speed detection means.

8. An internal combustion engine fuel supply amount control apparatus according to claim 6, further comprising:

intake air temperature detection means for detecting an intake temperature of air which flows into the internal combustion engine; and cooling water temperature detection means for estimating a cooling water temperature of cooling water circulating in the internal combustion engine, wherein the basic air-fuel ratio estimation means is corrected based on the intake air temperature detected by the intake air temperature detection means and the cooling water temperature of the internal combustion engine detected by the cooling water temperature detection means.

9. An internal combustion engine fuel supply amount control apparatus according to any one of claim 1, wherein the variation amount calculation means performs calculation by each cylinder of the internal combustion engine.

10. An internal combustion engine fuel supply amount control apparatus according to any one of claim 1, wherein the variation amount calculation means corrects a current variation amount based on a previous variation amount.

11. An internal combustion engine fuel supply amount control apparatus comprising:

load detection means for detecting a load on an internal combustion engine;

air-fuel ratio estimation means for estimating an air-fuel ratio of the internal combustion engine during a predetermined period based on the load on the internal combustion engine detected by the load detection means;

fuel injection amount control means for controlling a fuel injection amount based on the air-fuel ratio estimated by the air-fuel ratio estimation means; and an air-fuel sensor is-provided in an exhaust passage of the internal combustion engine, wherein said predetermined period ranges from startup of the internal combustion engine to activation of the air-fuel sensor.

12. An internal combustion engine fuel supply amount control apparatus comprising:

load detection means for detecting a load on an internal combustion engine;

air-fuel ratio estimation means for estimating an air-fuel ratio of the internal combustion engine during a predetermined period based on the load on the internal combustion engine detected by the load detection means;

fuel injection amount control means for controlling a fuel injection amount based on the air-fuel ratio estimated by the air-fuel ratio estimation means;

target air-fuel ratio setting means for setting a target air-fuel ratio; and air-fuel ratio control means for controlling the air-fuel ratio estimated by the air-fuel ratio estimation means to follow the target air-fuel ratio set by the target air-fuel ratio setting means based on a deviation between the target air-fuel ratio and the air-fuel ratio.

13. An internal combustion engine fuel supply amount control apparatus comprising:

rotation speed detecting means for detecting a rotation speed of the internal combustion engine;

variation amount calculation means for calculating a rotation speed variation amount based on the rotation speed detected by the rotation speed detection means;

average value calculation means for calculating a rotation speed average value based on the rotation speed during the predetermined period detected by the rotation speed detection means;

air-fuel ratio estimation means for estimating an air fuel ratio of the internal combustion engine based on the rotation speed variation amount calculated by the variation amount calculation means and the rotation speed average value calculated by the average value calculation means; and fuel injection amount control means for controlling a fuel injection amount based on the air-fuel ratio estimated by the air-fuel ratio estimation means.

* * * * *